United States Patent [19]

Maruta et al.

[11] Patent Number: 4,929,590

[45] Date of Patent: May 29, 1990

[54] THERMOSENSITIVE RECORDING MATERIAL

[75] Inventors: Keiichi Maruta; Takashi Ueda, both of Numazu; Yasuhiko Watanabe, Shizuoka, all of Japan

[73] Assignee: Ricoh Company, Ltd., Tokyo, Japan

[21] Appl. No.: 317,979

[22] Filed: Mar. 2, 1989

[51] Int. Cl.[5] ..... B41M 5/18

[52] U.S. Cl. ..... 503/207; 427/152; 503/200; 503/214; 503/226

[58] Field of Search ..... 503/200, 207, 214, 226; 428/327, 342, 913, 914, 341; 427/152, 150, 151

[56] References Cited

U.S. PATENT DOCUMENTS 4,616,240 10/1986 Inaba et al. ..... 503/207
4,798,820 1/1989 Yaguchi et al. ..... 503/207

FOREIGN PATENT DOCUMENTS 5093 1/1984 Japan ..... 503/207
248390 12/1985 Japan ..... 503/207

*Primary Examiner*—Pamela R. Schwartz
*Attorney, Agent, or Firm*—Oblon, Spivak, McClelland, Maier & Neustadt

[57] ABSTRACT

A thermosensitive recording material is disclosed, which comprises (a) a support, (b) an undercoat layer formed on the support, which comprises spherical hollow particles made of a plastic material having a glass transition temperature ranging from 40° C. to 90° C., the spherical hollow particles having a mean particle diameter of 0.20 μm to 1.5 μm, and a voidage of 40% to 90%, and a binder resin in an effective amount, and (c) a thermosensitive coloring layer formed on the undercoat layer, which comprises as the main components a leuco dye and a color developer capable of inducing color formation in the leuco dye upon application of heat thereto.

11 Claims, No Drawings

THERMOSENSITIVE RECORDING MATERIAL

BACKGROUND OF THE INVENTION

1. Field of the Invention

This invention relates to a thermosensitive recording material, and more particularly to an improved thermosensitive recording material comprising a support, an undercoat layer formed on the support, and a thermosensitive coloring layer formed on the undercoat layer.

2. Discussion of Background

Recently, various information recording materials of a non-enviromental-pollution type, capable of nursing resources and economizing energy, have been developed and put to practical use for the purpose of dealing with a great variety of abundant information. In particular, thermosensitive recording materials have been widely employed in various fields, for instance, for use with terminal printers for computers and calculators, recorders for medical measurement instruments, low- and high-speed facsimile apparatus, automatic ticket vending apparatus, copying machines, and label printing machines for the POS system, because of the following advantages thereof:

(1) images can be readily recorded on a thermosensitive recording material by simply applying heat thereto without employing a complicated development process;

(2) a relatively simple and small-sized apparatus is available for preparing a thermosensitive recording material, handling of the recording material is easy, and the maintenance cost of the same is inexpensive; and (3) in the case where paper, which is not costly as compared with other materials, is used as a support, a thermosensitive recording material with the plain paper-like touch is obtainable.

In general, the thermosensitive recording material is prepared by coating a liquid for forming a thermosensitive coloring layer, which contains a coloring component for color formation by application of heat, onto the surface of paper, synthetic paper or a plastic film, and then dried. Images are recorded on the thus prepared recording material by a thermal pen or thermal head. Such thermosensitive recording materials are disclosed, for instance, in Japanese Patent Publications Nos. 43-4160 and 45-14039. These conventional recording materials, however, sluggishly respond to thermal energy, so that images with high color density are not obtainable when high-speed recording is performed.

In order to overcome the above shortcomings, it have been proposed to incorporate the following compounds into the conventional thermosensitive recording materials: nitrogen-containing compounds such as acetamide, stearamide, m-nitroaniline and dinitrile phthalate (Japanese Laid-Open Patent Application No. 49-38424; acetoacetic anilide (Japanese Laid-Open Patent Application No. 52-106746); N,N-diphenylamine derivatives, benzamide derivatives and carbazole derivatives (Japanese Laid-Open Patent Application No. 53-11036); alkylated biphenyl and biphenyl alkane (Japanese Laid-Open Patent Application No. 53-39139); and p-hydroxy benzoate (Japanese Laid-Open Patent Application No. 56-144193). However, satisfactory recording materials cannot be obtained by incorporating any of the above compounds.

Japanese Laid-Open Patent Application No. 56-164890 discloses that the thermal sensitivity of a thermosensitive recording material can be improved by using an amorphous leuco dye, which is obtained by converting the corresponding crystalline leuco dye to the amorphous leuco dye, and has a lower melting point than that of the corresponding crystalline leuco dye. Such amorphous leuco dyes, however, are highly reactive because of their activated surfaces, so that a liquid for forming a thermosensitive coloring layer containing such an amorphous leuco dye causes a so-called liquid fogging, or the thermosensitive recording material containing the same causes the fogging of the background, thereby reducing the whiteness of the background.

In order to prevent the fogging of the background and to enhance the dynamic coloring sensitivity of the recording material, several methods described below have been proposed. For instance, a material having a thermal conductivity of 0.04 Kcal/mh° C. or less is employed as a support as disclosed in Japanese Laid-Open Patent Application No. 55-164192; and a layer comprising fine hollow particles as the main component is formed on a support as disclosed in Japanese Laid-Open Patent Applications No. 59-5093 and 59-225987. However, the thermosensitive recording materials prepared in the above manners are not satisfactory because they have low flexibility, poor heat insulating properties, and low thermal head-matching ability.

Japanese Laid-Open Patent Application No. 62-5886 discloses a thermosensitive recording material comprising an intermediate layer which contains non-expandable fine hollow particles made of a thermoplastic resin, having a diameter of 5 μm or less. The use of such hollow particles, however, is not a decisive manner for preparing a thermosensitive recording material having high sensitivity.

SUMMARY OF THE INVENTION

It is therefore an object of the present invention to provide a thermosensitive recording material having high thermal coloring sensitivity.

The object of the present invention can be attained by a thermosensitive recording material comprising (a) a support, (b) an undercoat layer formed on the support, which comprises (i) spherical hollow particles made of a plastic material having a glass transition temperature ranging from 40° C. to 90° C., the spherical hollow particles having a mean particle diameter of 0.20 μm to 1.5 μm, and a voidage of 40% to 90%, and (ii) a binder resin in an effective amount, and (c) a thermosensitive coloring layer formed on the undercoat layer, which comprises as the main components a leuco dye and a color developer capable of inducing color formation in the leuco dye upon application of heat thereto.

DETAILED DESCRIPTION OF THE PREFERRED EMBODIMENTS

The undercoat layer of the present invention comprising fine spherical hollow particles serves as a heat-insulating layer, and effectively utilizes the thermal energy provided by a thermal head. Thus the thermal coloring sensitivity of the recording material can be improved.

The spherical hollow particle employed in the present invention has a shell made of a plastic material, and contains air or gas inside the shell. Therefore, it is deemed that the particle is in an expanded state.

In order to obtain the improved thermal coloring sensitivity and to prevent color formation in the background in the course of a super-calendering process, plastic materials having a glass transition temperature ranging from 40° C. to 90° C. are preferably used for the shell of the spherical hollow particles.

A preferable mean diameter of the hollow particles is in the range of 0.20 um to 1.5 μm, when the production cost of the particles and the sensitivity of the final recording material are taken into consideration. As a matter of course, it is preferable that the particles be uniform in size as much as possible.

A desirable voidage of the hollow particle is in the range of 40% to 90% from the view point of the production efficiency and the sensitivity of the recording material. It is noted that the voidage mentioned in this specification is directed to a ratio of the inner diameter to the outer diameter of the hollow particle, and expressed by the following equation.

$$\text{Voidage (\%)} = \frac{\text{Inner Dia. of Hollow Particle}}{\text{Outer Dia. of Hollow Particle}} \times 100$$

The hollow particles for use in the present invention can be readily and inexpensively prepared by using acrylic resins such as polyacrylic ester and polyacrylonitrile, styrene resins such as polystyrene, and their copolymer resins.

The undercoat layer in the present invention is formed on the support in the below described manner. Namely, the above-described spherical hollow particles made of the plastic material are dispersed in water with a known binder resin such as a water-soluble polymer and an aqueous polymer emulsion. The thus prepared dispersion is coated onto the surface of a support, followed by drying the coated dispersion to form the undercoat layer. In the above, the coating amount of the hollow particles on the support 1 is at least g/m$^2$, preferably 2 g/m$^2$ to 15 g/m$^2$. The binder resin can be used in any amount as far as the undercoat layer can be firmly fixed to the support, and, normally, it is employed in an amount of 2 to 50 wt. % of the total weight of the hollow particles and the binder resin.

The binder resin is preferably selected from conventionally known water-soluble polymers and polymers capable of forming an aqueous polymer emulsion.

Examples of the water-soluble polymers include polyvlnyl alcohol, starch and derivatives thereof, cellulose derivatives such as methoxycellulose, hydroxyethylcellulose, carboxymethylcellulose, methylcellulose and ethylcellulose, sodium polyacrylate, polyvinyl pyrrolidone, acrylamide-acrylic acid ester copolymer, acrylamide-acrylic acid ester-methacrylic acid copolymer, alkali salts of styrene-maleic anhydride copolymer, alkali salts of isobutylene-maleic anhydride copolymer, polyacrylamide, sodium alginate, gelatin and casein.

Examples of the polymers capable of forming an aqueous polymer emulsion include styrene-butadiene copolymer, styrene-butadiene-acrylic acid copolymer, vinyl acetate resin, vinyl acetate-acrylic acid copolymer, styrene-acrylic acid ester copolymer, acrylic acid ester resin and polyurethane resin. These polymers are practically employed, as a binder, in a state of latex or aqueous emulsion.

Together with the above spherical hollow particles and the binder resin, any auxiliary components which are commonly used in a thermosensitive recording material, such as fillers, thermofusible materials and surface active agents can be employed in the undercoat layer in the present invention. Examples of the fillers and the thermofusible materials will be mentioned later in relation to the thermosensitive coloring layer in the present invention.

The undercoat layer prepared in the aforementioned manner has a considerably rough surface, so that it is preferable to make it smooth by calendering.

Any known leuco dyes for use in conventional thermosensitive recording materials are employable in the present invention. Preferable examples of the leuco dyes include triphenylmethane-type leuco compounds, fluoran-type compounds, phenothiazine-type leuco compounds, auramine-type leuco compounds, spiropyran-type leuco compounds and indolinophthalide-type leuco compounds, and these are employed alone or in combination. The followings are the specific examples of such leuco dyes:

3,3-bis(p-dimethylaminophenyl)-phthalide,
3,3-bis(p-dimethylaminophenyl)-6-dimethylaminophthalide (or Ctystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl 7-anilinofluoran,
3-diethylamino-6-methyl-7-anilinofluoran,
3-(N,N-diethylamino)-5-methyl-7-(N,N-dibenzylamino) fluoran,
Benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)-fluoran,
3-pyrrolidino-7-trifluoromethylanilinofluoran,
3-dlethylamino-5-chloro-7-(N-benzyl-trifluoromethylanilino)fluoran, 3-pyrrolidino-7-(di-p-chlorophenyl)methylamino-fluoran,
3-diethylamino-5-chloro-7-(o-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4',5'-benzofluoran,
3
3-N-methyl-N-isopropyl-6-methyl-7-anilinofluoran,
3-N-ethyl-N-amyl-6-methyl-7-anilinofluoran, and
3-diethylamino-6-methyl-7-(2',4'-dimethylanilino)-fluoran.

As the color developers, various known electronacceptor type compounds and oxidizing agents which induce color formation in the leuco dyes upon application of heat thereto are usable in the present invention. Examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)-butane,
1,1,3-tris(2-methyl-4-hydroxy-5-cyclohexylphenyl)-butane,
4,4'-thiobis(6-tert-butyl-2-methyl)phenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate, lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
2-hydroxy-1-naphthoic acid,
1-hydroxy-2-naphthoic acid,
zinc salts of hydroxynaphthoic acid,
aluminum salts of hydroxynaphthoic acid,
calcium salts of hydroxynaphthoic acid,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenylsulfone,
2,2'-diallyl-4,4'-diphenolsulfone,
3,4-dihydroxyphenyl-4'-methylphenylsulfone,
α,α-bis(4-hydroxyphenyl)-α-methyltoluene,
antipyrine complex of zinc thiocyanate,
tetrabromobisphenol A, and
tetrabromobisphenol S.

Various known binder resins are usable together with the leuco dyes and the color developers to form the thermosensitive coloring layer on the undercoat layer. Examples of such binder resins are identical to those of the binder resins usable for forming the undercoat layer of the present invention.

Auxiliary components such as fillers, thermofusible materials and surface active agents which are usable in conventional thermosensitive recording materials are also employable in the thermosensitive coloring layer of the present invention, if necessary.

Examples of such fillers include fine powder of inorganic compounds such as calcium carbonate, silica, zinc oxide, titanium oxide, aluminum hydroxide, zinc hydroxide, barium sulfate, clay, talc, surface-treated calcium, and surface-treated silica; and fine powder of organic compounds such as urea-formaldehyde resin, styrene-methacrylic acid copolymer, and polystyrene resin. These fillers are also usable in the aforementioned undercoat layer in the present invention.

Examples of the thermofusible materials include higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° to 200° C. These materials are also usable in the aforementioned undercoat layer in the present invention.

In the present invention, an intermediate layer comprising fillers, binder resins and thermofusible materials can be formed between the undercoat layer and the thermosensitive coloring layer, if necessary. Examples of such fillers, binder resins and thermofusible materials are the same as those mentioned in relation to the thermosensitive coloring layer and the undercoat layer.

Furthermore, a protective layer also can be formed on the thermosensitive coloring layer for the purpose of improving the thermal head-matching ability and preservability of the recorded images. The protective layer may comprise fillers, binder resins, surface active agents and thermofusible materials, which are enumerated above.

The thermosensitive recording material of the present invention is prepared by successively overlaying the undercoat layer and the thermosensitive coloring layer, in this order, on a support made of paper, synthetic paper or plastic film. The thus prepared recording materials, which are excellent in the thermal coloring sensitivity, are utilized in various fields.

This invention will now be explained more specifically by referring to the following examples and comparative examples. These examples are give for illustration of the invention and are not intended to be limiting thereof.

EXAMPLE 1

Procedure 1

Dispersion A and Dispersion B each having the following formulations were prepared by using a sandmill. A mean diameter of particles contained in each dispersion was adjusted to 2 μm or less.

The thus prepared Dispersions A and B were admixed in a weight ratio of 1:8 to prepare a liquid for forming a thermosensitive coloring layer coating liquid.

| [Formulation of Dispersion A] | parts by weight |
|---|---|
| 3-(N-Methyl-3-N-cyclohexyl)amino-6-methyl-7-anilinofluoran | 20 |
| Polyvinyl alcohol | 20 |
| Water | 60 |
| **[Formulation of Dispersion B]** | **parts by weight** |
| Benzyl p-hydroxybenzoate | 10 |
| 10% Aqueous polyvinyl alcohol solution | 25 |
| Calcium carbonate | 15 |
| Water | 50 |

Procedure 2

In order to form an undercoat layer, Dispersion C having the following formulation was prepared by using a diaper. The dispersion in an amount of 6 g/m$^2$ on a dry basis was coated onto commercially available high quality paper having a thickness of 52 g/m$^2$, and dried to prepare an undercoat sheet.

| [Formulation of Dispersion C] | parts by weight |
|---|---|
| Dispersion of spherical hollow particles* of styrene - acrylic resin (solid content 47%) | 40 |
| 10% aqueous polyvinyl alcohol solution | 10 |
| Water | 50 |

*Glass transition temperature: 60° C.
Mean particle diameter: 0.4 μm
Voidage: 75%

Procedure 3

The liquid for forming a thermosensitive coloring layer prepared in Procedure 1 was coated onto the undercoat sheet prepared in Procedure 2 in an amount of 7 g/m$^2$ on a dry basis, followed by drying the coated liquid to form a thermosensitive coloring layer. Thereafter, the layer was subjected to a super-calender treatment so as to have a Bekk's smoothness of 500 to 600 seconds, whereby a thermosensitive recording material No. 1 according to the present invention was prepared.

EXAMPLE 2

Example 1 was repeated except that the spherical hollow particles of styrene-acrylic resin used for preparing Dispersion C were replaced by spherical hollow particles of styrene-acrylic resin having a glass transition temperature of 90° C., a mean particle diameter of 0.8 μm and a voidage of 60%, whereby a thermosensitive recording material No. 2 according to the present invention was prepared.

EXAMPLE 3

Example 1 was repeated except that the spherical hollow particles of styrene-acrylic resin used for preparing Dispersion C were replaced by spherical hollow particles of styrene - acrylic resin having a glass transition temperature of 40° C., a mean particle diameter of 0.6 μm and a voidage of 60%, whereby a thermosensitive recording material NO. 3 according to the present invention was prepared.

EXAMPLE 4

Example 1 was repeated except that the spherical hollow particles of styrene - acrylic resin used for preparing Dispersion C were replaced by spherical hollow particles of styrene-acrylic resin having a glass transition temperature of 60° C., a mean particle diameter of 1.5 μm and a voidage of 45%, whereby a thermosensitive recording material No. 4 according to the present invention was prepared.

COMPARATIVE EXAMPLE 1

Example 1 was repeated except that the spherical hollow particles of styrene - acrylic resin used for preparing Dispersion C were replaced by spherical non-hollow particles of styrene - acrylic resin (Trademark "SPMM-HS", solid content 40% made by Mitsui Toatsu Chemicals, Inc.) having a glass transition temperature of 60° C. and a mean particle diameter of 0.4 μm, whereby a comparative thermosensitive recording material No. 1 was prepared.

COMPARATIVE EXAMPLE 2

Example 1 was repeated except that the spherical hollow particles of styrene-acrylic resin used for preparing Dispersion C were replaced by spherical hollow particles of styrene-acrylic resin having a glass transition temperature of 110° C., a mean particle diameter of 3 μm and a voidage of 75%, whereby a comparative thermosensitive recording material No. 2 was prepared.

Evaluation

The above prepared four thermosensitive recording materials of the present invention and two comparative ones were evaluated by subjecting them to thermal printing using a thermosensitive facsimile apparatus (Trademark "RIFAX 120", made by Ricoh Company, Ltd.) so that images were recorded on each thermosensitive recording material, and the density of the respective recorded images was measured by using a Macbeth densitometer. The results are shown in the table below.

| Samples | Glass Transition Temperature | Mean Particle Diameter | Voidage | Image Density |
|---|---|---|---|---|
| Recording Material No. 1 | 60° C. | 0.4 μm | 75% | 1.35 |
| Recording Material No. 2 | 90° C. | 0.8 μm | 60% | 1.34 |
| Recording Material No. 3 | 40° C. | 0.6 μm | 60% | 1.33 |
| Recording Material No. 4 | 60° C. | 1.5 μm | 45% | 1.30 |
| Comparative Recording Material No. 1 | 60° C. | 0.4 μm | — | 1.25 |
| Comparative Recording Material No. 2 | 110° C. | 3 μm | 75% | 1.28 |

The above data indicate that the thermosensitive recording materials of the present invention have high thermal coloring sensitivity compared with the comparative recording materials.

What is claimed is:

1. A thermosensitive recording material comprising:
(a) a support,
(b) an undercoat layer formed on said support, which comprises spherical hollow particles made of a plastic material having a glass transition temperature ranging from 40° C. to 90° C., said spherical hollow particles having a mean particle diameter of 0.20 um to 1.5 μm, and a voidage of 40% to 90%, and a binder resin in an effective amount, and
(c) a thermosensitive coloring layer formed on said undercoat layer, which comprises as the main components a leuco dye and a color developer capable of inducing color formation in said leuco dye upon application of heat thereto.

2. The thermosensitive recording material as claimed in claim 1, wherein said plastic material for said spherical hollow particles is selected from the group consisting of acrylic copolymer, and styrene copolymer.

3. The thermosensitive recording material as claimed in claim 1, wherein the amount of said spherical hollow particle in said undercoat layer is at least 1 g per 1 $m^2$ of said support.

4. The thermosensitive recording material as claimed in claim 3, wherein the amount of said spherical hollow particles in said undercoat layer is in the range of 2 g to 15 g per 1 $m^2$ of said support.

5. The thermosensitive recording material as claimed in claim 1, wherein the amount of said binder resin in said undercoat layer is in the range of 2 to 50 wt. % of the total weight of said binder resin and said spherical hollow particles.

6. The thermosensitive recording material as claimed in claim 1, wherein said binder resin is a water-soluble polymer.

7. The thermosensitive recording material as claimed in claim 6, wherein said water-soluble polymer is selected from the group consisting of polyvinyl alcohol, starch, cellulose, methoxycellulose, hydroxyethylcellulose, carboxymethyl-cellulose, methylcellulose, ethylcellulose, sodium polyacrylate, polyvinyl pyrrolidone, acrylamide-acrylic acid ester copolymer, acrylamide-acrylic acid ester-methacrylic acid copolymer, alkali salts of styrene-maleic anhydride copolymer, polyacrylamide, sodium alginate, gelatin and casein.

8. The thermosensitive recording material as claimed in claim 1, wherein said binder resin is a polymer capable of forming an aqueous polymer emulsion.

9. The thermosensitive recording material as claimed in claim 8, wherein said polymer capable of forming an aqueous polymer emulsion is selected from the group consisting of styrene-butadiene copolymer, styrene butadiene-acrylic acid copolymer, vinyl acetate resin, vinyl acetate-acrylic acid copolymer, styrene-acrylic acid ester copolymer, acrylic acid ester resin and polyurethane resin.

10. The thermosensitive recording material as claimed in claim 1, further comprising an intermediate layer between said undercoat layer and said thermosensitive coloring layer, said intermediate layer comprising a filler and a binder resin.

11. The thermosensitive recording material as claimed in claim 1, further comprising a protective layer formed on said thermosensitive coloring layer, said protective layer comprising a filler and a binder resin.

* * * * *

UNITED STATES PATENT AND TRADEMARK OFFICE

CERTIFICATE OF CORRECTION

PATENT NO. : 4,929,590

DATED : May 29, 1990

INVENTOR(S) : MARUTA ET AL.

It is certified that error appears in the above-identified patent and that said Letters Patent is hereby corrected as shown below:

At column 1, line 49:

"it have" should read: --it has--;

At column 3, line 4:

"range of 0.20 um" should read: --range of 0.20 μm--;

At column 4, line 14:

"The followings" should read: --The following--;

At column 4, line 18:

"(or Ctystal Violet Lactone)" should read:

--(or Crystal Violet Lactone)--;

At column 4, line 42:

"-6- methyl 7-anilinofluoran" should read:

---6- methyl-7-anilinofluoran--;

At column 4, line 67:

"3-dlethylamino-5-chloro" should read:

--3-diethylamino-5-chloro--;

UNITED STATES PATENT AND TRADEMARK OFFICE

CERTIFICATE OF CORRECTION

PATENT NO. : 4,929,590

DATED : May 29, 1990

INVENTOR(S) : MARUTA ET AL.

It is certified that error appears in the above-identified patent and that said Letters Patent is hereby corrected as shown below:

At column 5, line 3:

"-chloro-7-(o-phenylethylamino)-" should read:

---chloro-7-(αphenylethylamino)---

At column 5, delete line 22;

At column 6, line 66:

"are give" should read: --are given;

At column 7, line 28:

"using a diaper." should read:

--using a disperser.--

UNITED STATES PATENT AND TRADEMARK OFFICE

CERTIFICATE OF CORRECTION

PATENT NO. : 4,929,590

DATED : May 29, 1990

INVENTOR(S) : MARUTA ET AL.

It is certified that error appears in the above-identified patent and that said Letters Patent is hereby corrected as shown below:

At column 9, line 11:

"0.20 um" should read:

--0.20 μm--

At column 10, line 8:

"carboxymethyl-cellulose" should read:

--carboxymethylcellulose--

Signed and Sealed this

Twelfth Day of May, 1992

*Attest:*

DOUGLAS B. COMER

*Attesting Officer*

*Acting Commissioner of Patents and Trademarks*